US005603743A

United States Patent [19]

Aschenbeck et al.

[11] Patent Number: 5,603,743

[45] Date of Patent: Feb. 18, 1997

[54] HIGH FREQUENCY AIR LAPPER FOR FIBROUS MATERIAL

[75] Inventors: David P. Aschenbeck, Newark; William A. Watton, Pickerington; James G. Snyder, Newark, all of Ohio

[73] Assignee: Owens-Corning Fiberglas Technology Inc., Summit, Ill.

[21] Appl. No.: 414,694

[22] Filed: Mar. 31, 1995

[51] Int. Cl.[6] ..... C03B 37/06

[52] U.S. Cl. ..... 65/458; 65/454; 65/459; 65/505; 65/517; 239/DIG. 21; 425/80.1

[58] Field of Search ..... 65/454, 455, 458, 65/459, 460, 505, 516, 517, 518; 239/290, 295, 296, 300, DIG. 21, 451, 456, 562, 566; 425/80.1, 81.1, 83.1; 264/120, 121, 517, 518

[56] References Cited

U.S. PATENT DOCUMENTS

| | | |
|---|---|---|
| 2,736,362 | 2/1956 | Slayter et al. . |
| 2,863,493 | 12/1958 | Snow et al. . |
| 2,897,874 | 8/1959 | Stalego et al. . |
| 2,931,076 | 4/1960 | Clark . |
| 3,026,585 | 2/1962 | Berthon et al. . |
| 3,134,145 | 5/1964 | Miller . |
| 3,295,943 | 1/1967 | Mabru . |
| 3,408,697 | 11/1968 | Craig . |
| 3,785,791 | 1/1974 | Perry . |
| 4,061,485 | 12/1977 | Rimmel . |
| 4,167,404 | 9/1979 | Loeffler et al. . |
| 4,244,719 | 1/1981 | Weiner . |
| 4,263,033 | 4/1981 | Michalek . |
| 4,266,960 | 5/1981 | Scott et al. . |
| 4,564,486 | 1/1986 | Wherry . |
| 4,592,769 | 6/1986 | Lemaignen . |
| 4,780,146 | 10/1988 | Chang . |
| 5,051,123 | 9/1991 | Nurmi . |
| 5,268,015 | 12/1993 | Furtak et al. . |

FOREIGN PATENT DOCUMENTS

| | | |
|---|---|---|
| 2338912 | 8/1977 | France . |
| 9530036 | 11/1995 | WIPO . |

*Primary Examiner*—David A. Simmons
*Assistant Examiner*—M. Curtis Mayes
*Attorney, Agent, or Firm*—C. Michael Gegenheimer; Curtis B. Brueske

[57] ABSTRACT

A method and apparatus for distributing fibrous material includes establishing a flow of fibrous material, positioning at least two flow distributors in a position to direct a gaseous flow into contact with the flow of fibrous material, such as a flow of glass fibers, each flow distributor having an outer surface having one or more openings for the emission of gas, an inner surface having one or more orifices for the emission of gas, and a pressurized source of gas in contact with the inner surface, the inner surface being moveable with respect to the outer surface to intermittently align some of the openings with some of the orifices, thereby enabling gas from the pressurized source of gas to be emitted through the inner and outer surfaces and into contact with the flow of fibrous material to distribute the fibrous material, and moving one of the surfaces relative to the other of the surfaces to control the emission of gas from the flow distributor.

17 Claims, 3 Drawing Sheets

HIGH FREQUENCY AIR LAPPER FOR FIBROUS MATERIAL

TECHNICAL FIELD

This invention relates to establishing a flow of fibrous material and distributing the fibrous material by engaging it with gaseous flows from a distributor to be able to collect the fibrous material with a generally uniform thickness on a collecting surface. In a specific aspect of the invention, it relates to the distribution of glass fibers to form a glass fiber product of uniform thickness.

BACKGROUND

Numerous manufacturing processes require the use of means of distributing streams or flows of fibrous material to produce the desired end product. Often, the process for manufacturing fibrous material results in a flow of fibrous material having a generally non-uniform fiber distribution which is not easily collected into a final product having a uniform thickness and density. Also, typical flows of fibrous materials generated from fiber manufacturing steps frequently have a cross-sectional width which is narrow relative to the width ultimately desired for the final product. Consequently, the fibers must be distributed to make an acceptable product.

Mineral fibers can be made from molten mineral material, such as glass, using any one of several well known processes, such as the rotary process. The rotary process results in a downwardly moving, cylindrically shaped flow of glass fibers and gases, commonly referred to as a veil. An example of a flow of fibers requiring distribution is the veils of glass fibers produced in the manufacture of mineral fibers, such as glass fibers. There is a need to distribute and disburse the fibers to form a wide blanket or pack having a generally uniform thickness and density.

Numerous devices have been used in the past to effect uniform distribution of flows of fibrous materials, including baffles, chutes, Coanda surfaces, mechanical lappers, air nozzles and air knives. Typically, a fibrous flow or veil is impinged upon by opposed lapping devices, such as air nozzles. The opposed lapping devices operate alternately to distribute the fibrous material back and forth across the width of a moving collection surface. When an oscillating surface or pulsating air jets from air nozzles or air knives are used, there is an inherent limitation on the effective frequency of the lapping or distributing device. Mechanical inertia limits mechanical lapping devices, and air driven lappers are usually limited by inertia and accumulator effects. The highest effective frequency of known mechanical or air jet lapping devices is about 1 to 2 hz.

One technique used in the past to help the process of distributing fibrous flows, particularly cylindrically shaped fibrous flows, is the use of a pair of opposed foraminous drums which flatten the fibrous flow and remove much of the air flowing with the fibers. The flattened fibrous flow should be easier to distribute because much of the air has been removed. A recent improvement in the use of foraminous drums is to operate the drums at a very high speed, with the tangential rate of the drum surfaces approximating the speed of the fibers in the fibrous flow. The use of high speed drums is disclosed in more detail in U.S. patent application Ser. No. 08/236,067, filed May 2, 1994, naming Aschenbeck et al. as inventors, and hereby incorporated by reference. The flattened veil from the foraminous drums is believed to be easier to distribute or lap from side to side because most of the air has been removed from the flow of fibers.

It would be highly desirable to be able to lap the fibrous flows at a rate faster than that allowed by conventional lapping techniques. Lapping at faster rates would lead to more uniform distribution of the fibrous material in the final product.

DISCLOSURE OF INVENTION

There has now been developed a method and apparatus for lapping or distributing fibers in a flow of fibrous materials which enables lapping with much faster cycle times than previously known. Cycle times well above 2 hz. and as high as 100 hz. are expected. The method and apparatus of the invention involve the use of a flow distributor having two surfaces sliding or passing closely across each other. The surfaces comprise part of the containment of a pressurized air chamber in the flow distributor. The relative movement of the two surfaces causes orifices or openings in the surfaces to occasionally become aligned with each other, thereby intermittently enabling the emission of a burst of air from the pressurized air chamber. The gaseous flows from the flow distributor impinge on the flow of fibrous material, and the fibrous material is lapped or distributed onto the collecting surface. Use of the invention provides improved cross-machine weight distribution of the fibrous material on the collection surface.

According to this invention, there is provided a method for distributing fibrous material comprising establishing a flow of fibrous material, positioning at least two flow distributor in a position to direct a gaseous flow into contact with the flow of fibrous material, each flow distributor comprising a first surface having a set of one or more openings for the emission of gas, a second surface having a set of one or more orifices for the emission of gas, and a pressurized source of gas in contact with the second surface, one of the first and second surfaces being moveable with respect to the other of the first and second surfaces to intermittently align some of the openings with some of the orifices, thereby enabling gas from the pressurized source of gas to be emitted through the first and second surfaces and into contact with the flow of fibrous material to distribute the fibrous material, and moving one of the first and second surfaces relative to the other of the first and second surfaces to control the emission of gas from the flow distributor.

The cycle time of the intermittent flow of gas is preferably within the range of from about 1 to about 100 hz., more preferably within the range of from about 2 to about 50 hz., and most preferably within the range of from about 5 to about 40 hz.

In a preferred arrangement, a pair of flow distributors is positioned on opposite sides of the flow of fibrous material to distribute the fibrous material. The two flow distributors can be operated in an alternating fashion to emit gas from first one of the flow distributors and then the other.

The movement of one of the surfaces with respect to the other can be accomplished by oscillating one of the surfaces relative to the other. In a specific embodiment of the invention, one of the surfaces is mounted for movement as a flexible belt relative to the other of the surfaces.

In another specific embodiment of the invention, the first surface is a first cylinder having an opening directed toward the flow of fibrous material, and the second surface is a second cylinder mounted for rotation within the first cylinder, where the second cylinder contains orifices, and where the rotation of the second cylinder intermittently aligns the orifices with the opening.

In a preferred embodiment of the invention, the flow of fibrous material is established by centrifuging fibers from a rotary fiberizer and turning the fibers into a downwardly moving, generally cylindrical veil, and the veil is intercepted by a pair of rotating foraminous drums to change the veil into a generally flat flow of fibrous material. At least two flow distributors are preferably positioned to direct gaseous flows into contact with the generally flat flow of fibrous material to distribute the fibrous material.

According to this invention, there is also provided apparatus for distributing a flow of fibrous material comprising at least two flow distributors positioned to direct a gaseous flow into contact with the flow of fibrous material, each flow distributor comprising a first surface having a set of one or more openings for the emission of gas, a second surface having a set of one or more orifices for the emission of gas, and a pressurized source of gas in contact with the second surface, the first surface being moveable with respect to the second surface to intermittently align some of the openings with some of the orifices, thereby enabling gas from the pressurized source of gas to be emitted through the first and second surfaces and into contact with the flow of fibrous material to distribute the fibrous material, the second surface being moveable relative to the first surface to control the emission of gas from the flow distributor. In a specific embodiment of the invention, the set of openings in the first surface comprises a continuous slot.

BEST MODE FOR CARRYING OUT THE INVENTION

The invention will be described in terms of a process for manufacturing glass fibers and distributing them to make glass fiber products. It is to be understood that the invention is equally applicable to the distribution of fibers of other mineral material such as rock, slag and basalt, and to the distribution of fibers of organic material, such as fibers of cellulose, polypropylene, polyethylene and polyester. Also, although the fiber manufacturing is shown being carried out by a rotary process, the flow of fibrous materials can be produced by any manufacturing process.

Figure 1:
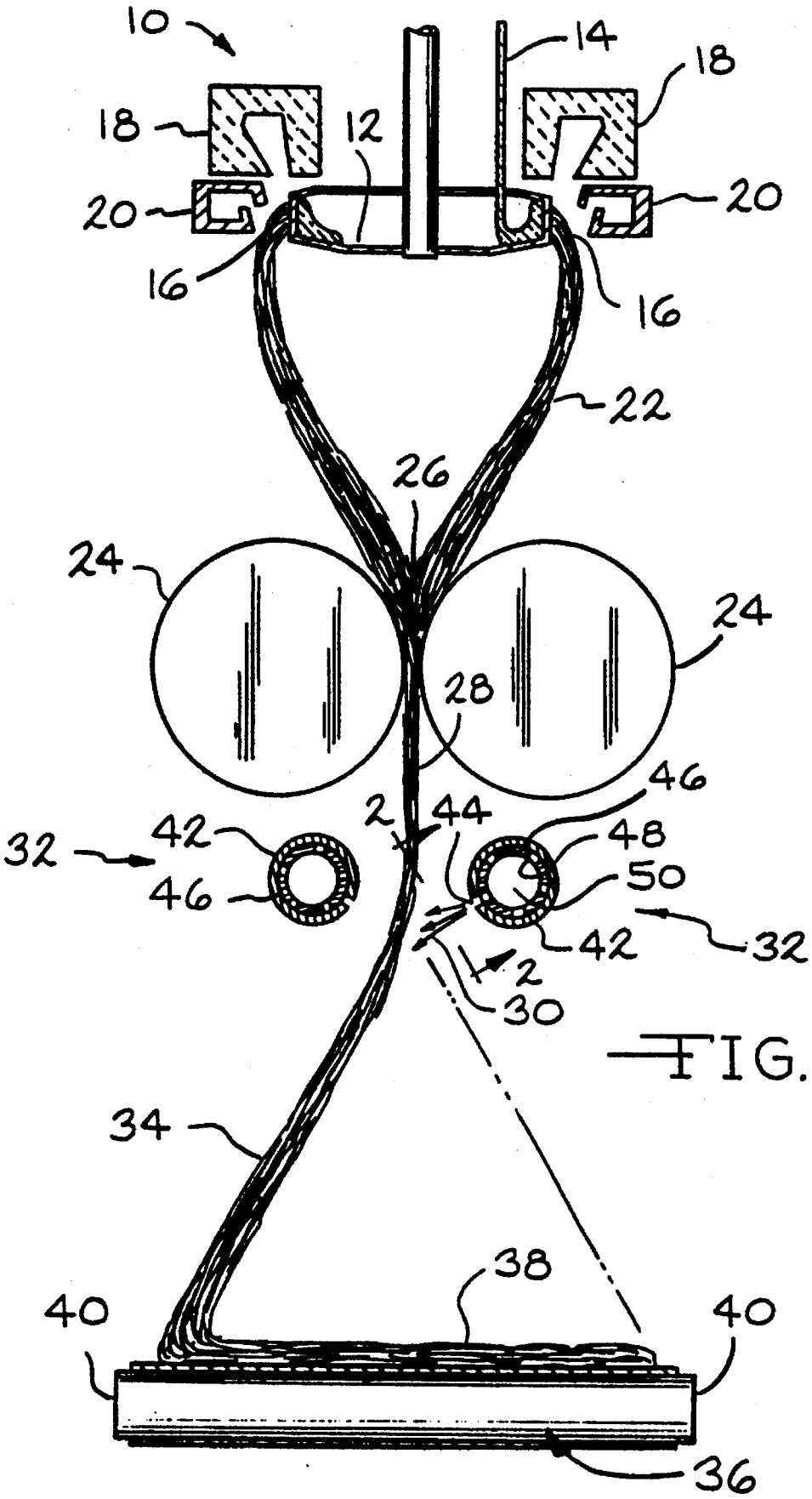
FIG. 1 is a schematic cross-sectional view in elevation of a rotary glass fiber manufacturing process in which the glass fibers are distributed according to the method and apparatus of the invention.

As shown in FIG. 1, the glass fibers are produced by a rotary fiberizer, indicated generally at 10. The fiberizer is comprised of a rotatably mounted spinner 12 which receives molten glass stream 14 from a forehearth or other source of molten glass, not shown. The molten glass is centrifuged through the orificed spinner sidewall into glass fibers 16. The glass fibers can be maintained in a plastic, attenuable state by an external annular burner 18, although the external burner is optional. The glass fibers can be further attenuated into finer fibers by the action of an annular blower 20. The blower turns the glass fibers into a flow of fibrous material which is a downwardly moving, generally cylindrical flow of gasses and glass fibers, in the form of veil 22. In a typical rotary glass fiber-forming operation, the veil has a diameter within the range of from about 20 to about 75 cm (about 9 to about 30 inches). The operation of a rotary fiber forming operation for making glass fibers is well known in the art. Other sources for the flow of fibrous materials include a rotary process for making organic fibers, not shown, and fiber picking and fluffing machines, not shown, for producing a flow of cellulose fibers.

In a preferred embodiment of the invention, the veil is intercepted by high-speed rotating conveyor surfaces, such as foraminous drums 24, which are in a spaced relationship, defining a gap 26 between the two drums. A suction apparatus, not shown, is positioned to exhaust gases from the veil through at least one of the drums. As the veil is conveyed through the gap, a major portion of the air and other gases in the veil is removed. Also, the generally cylindrical veil is formed into a generally flat flow or web 28 of fibrous material. The drums are generally effective to flatten the veil to a thickness within the range of from about 0.01 to about 0.2 of the width or diameter of the cylindrical veil of glass fibers. The downward veil velocity beneath the fiberizer at the same distance beneath the fiberizer as is the gap 26, but with the foraminous drums removed, is typically within the range of from about 3 to about 100 meters per second, and most likely within the range of from about 5 to about 30 meters per second. It has been found advantageous to rotate the drums at a speed sufficient to provide a tangential or surface velocity approximating the veil velocity, although higher or lower speeds might also be advantageous. This causes the veil to collapse into a flat flow of fibers, and removes gases from the veil, with a minimum amount of damage to the glass fibers, and a minimum amount of unnecessary fiber entanglement. A drum configuration suitable for use with the invention would include a pair of drums each about 0.6 meters in diameter, with a gap 26 of about 1.25 cm, and with the drum axes of rotation about 0.9 meters below the bottom of the spinner.

After leaving the foraminous drums, the web 28 is intercepted by one or more flows of gas 30 emitted from one or more flow distributors 32. The flow distributors are preferably operated in an alternating manner so that first one flow distributor is activated, and then the other, so that the web is met by gaseous flows 30 from alternate sides of the web. The lapped or lower portion 34 of the web is laid or folded in an overlapping manner on the collection surface, which can be any suitable surface, such as conveyor 36. The conveyor is moving toward the viewer in the illustration of FIG. 1. The cross machine direction is from left to right as viewed in FIG. 1. The lapped web forms glass fiber blanket 38 between the edges 40 of the conveyor. It has been discovered that it is highly desirable to lap or fold the web in a flat fashion, with no wrinkles, and with the individual folds of the web being of such a length as to extend from edge to edge of the conveyor. Also, it is important not to stretch the web because this could cause nonuniformities in density. By lapping the web precisely from edge to edge, without wrinkling, the glass fiber blanket will have the most uniform thickness and density in the cross machine direction.

The flow distributors can be of any type having surfaces which move relative to one another to enable the intermittent discharge of air or other gases to distribute or lap the web of fibers. In the embodiment shown in FIG. 1, the flow distributors comprise a first surface, such as stationary outer cylinder 42 having an opening 44 which is aimed at the web 28. The opening can be a continuous slot or can be a series of apertures. Positioned concentrically within the outer cylinder, and mounted for rotation, is a second surface, such as inner cylinder 46. The inner cylinder can be rotated by any suitable device, such as a motor, not shown. The motor can be controlled by any suitable control device, such as a computer, not shown, to operate at a predetermined speed or at a speed responsive to sensed values of various parameters, such as at speeds responsive to the sensed density uniformity of the ultimate glass fiber product. The computer can also be configured to coordinate the rotation speeds of both the left and right inner cylinders 46 of the two flow distributors.

Figure 2:
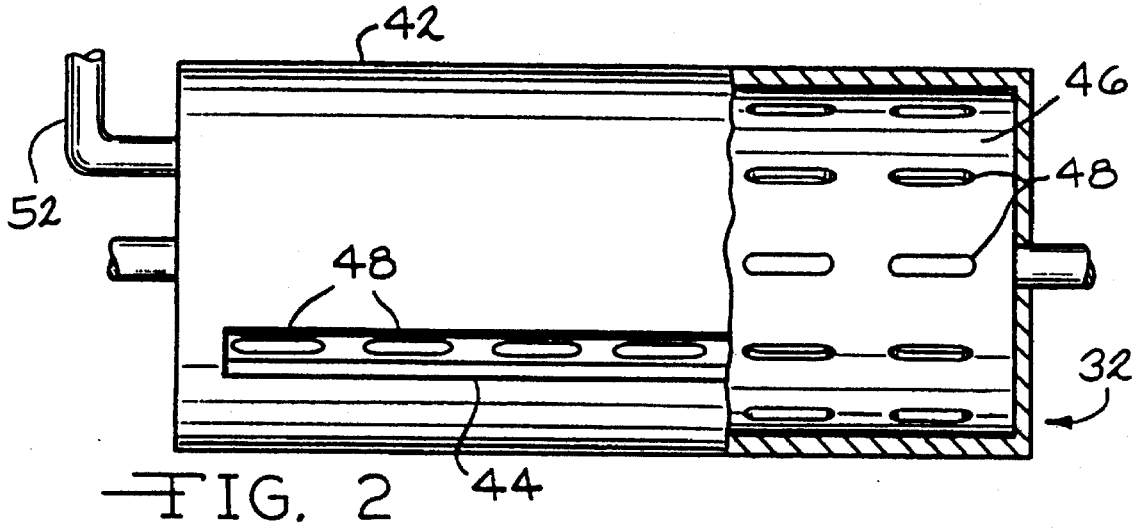
FIG. 2 is a schematic plan view, partially cut away, of the flow distributor, taken along lines 2—2 of FIG. 1.

The inner cylinder is adapted with one or more apertures, such as series of orifices 48, for the emission of gas from the flow distributor. As shown in FIG. 2, the rotation of the inner cylinder within the outer cylinder causes the inner cylinder orifices 48 to be intermittently aligned with the outer cylinder slot or opening 44. The inner cylinder defines an interior cavity or air chamber 50, which can be pressurized to a pressure above atmospheric. The air chamber can be supplied with air or other gases by any suitable means, such as air conduit 52 shown in FIG. 2, with the air conduit connected to a source, such as a compressor, not shown, of pressurized air or other gases. The air pressure within the cylinder is preferably within the range of from about 70 to about 420 kPa (about 10 to about 60 psi). When the orifices 48 are aligned with the opening 44, the air within the chamber will be emitted in a short burst as a gaseous flow 30 directed toward the web 28. Although the configuration illustrated in FIGS. 1 and 2 shows the outer cylinder stationary and the inner cylinder rotating within the outer cylinder, it is to be understood that either of the two cylinders, or both, could be adapted for rotation for the periodic alignment of the inner surface orifices 48 with the outer surface openings 44 for the emission of gas from the flow distributor 32. It can be seen that the intermittent alignment of the two sliding surfaces, i.e., the inner and outer surfaces, to provide openings for the gas flows, acts in a similar manner as a plurality of rapidly opening and closing valves which are in intimate contact with the pressurized source of air, i.e., the pressurized air chamber 50.

By rotating the inner cylinder at a proper velocity with respect to the outer cylinder, it can be seen that the alignment of the orifices with the opening to create a gaseous flow can be made to occur at any desired frequency, such as within the range of from about 1 to about 100 hz. Preferably, the cycle time frequency is within the range of from about 2 to about 50 hz., and most preferably within the range of from about 5 to about 40 hz. The most desirable cycle time will depend on the geometry of the fiberizing and collecting apparatus and on the size of the veil. In general, the wider the collecting surface, the slower the cycle time. It is estimated that lapping a veil, which has been flattened into a flat web by passing the veil through high velocity foraminous drums, onto a 16-inch wide collecting surface would require lapping at a rate of approximately 20 hz.

Figure 3:
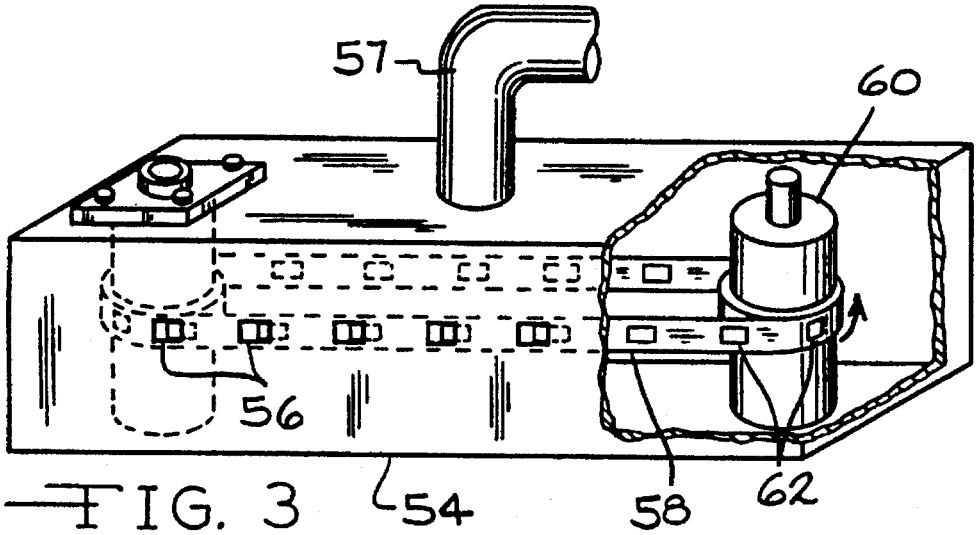
FIG. 3 is a schematic perspective view, partially cut away, of another embodiment of the flow distributor of the invention.

The movement of the first and second surfaces relative to each other is not limited to concentric cylinders. As shown in FIG. 3, the first surface can be a box-like container, such as outer distributor box 54. The outer distributor box is provided with a plurality of openings, such as outer distributor openings 56, although a single opening is possible as well. The outer distributor box is supplied with air via distributor air conduit 57 from a source, not shown. The second surface is in the form of a continuously moving strip or flexible belt 58 which is mounted for rotation about a pair of rotating wheels 60. The flexible belt is adapted with a series of apertures, such as belt orifices 62, which are shown as being rectangular in shape, but can be of any shape. The flexible belt 58 contacts the front face of the outer distributor box in a sliding relationship, and the belt orifices 62 periodically become aligned with the distributor openings 56 to enable an intermittent disbursement of gaseous flows from the distributor box 54. The air pressure within the distributor box may actually press the flexible belt into close contact with the front face of the distributor box. A preferred material for the flexible belt 58 is fiber-reinforced Teflon. A preferred material for the distributor box 54 is steel. Although the second surface or flexible belt 58 is shown to be inside the first surface, or outer distributor box 54, the flexible belt could be located outside the distributor box, as long as the first and second surfaces act together provide a periodic or intermittent alignment of the orifices of the flexible belt with the openings of the distributor box.

The arrangement and the size and shape of the openings of both the first surface and the second surface, and the speed of the flexible belt, are all designed so that the flow distributor will deliver intermittent bursts of gas in a simple and foolproof manner, with no accumulator effects of air flowing through pipes. Although the best coordination for alternating the gaseous flows from the two sides of the machine to produce a uniform density in a glass fiber product would use a periodic pattern, it is to be understood that the intermittent bursts of gaseous flows from the flow distributors could be provided according to a nonperiodic or even a random scheme.

Figure 4:
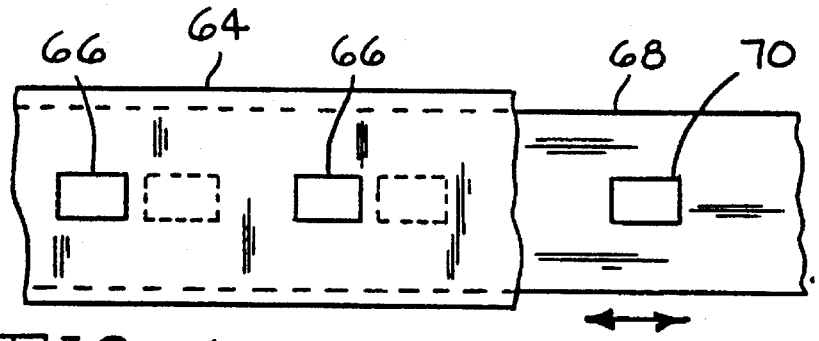
FIG. 4 is a view in elevation illustrating the inner and outer distributor surface of another embodiment of the invention.

As shown in FIG. 4, the first surface, or outer distributor surface 64 of a different embodiment of the invention is adapted with a plurality of outer distributor openings 66, and the inner distributor surface 68 is adapted with inner surface orifices 70. As shown, the inner distributor surface can be adapted to oscillate back and forth to intermittently align the inner surface orifices with the outer distributor openings.

Prior art flow distributors have been adapted in the past to supply generally on and off gaseous flows to distribute fibrous flows of materials. Typically, a glass fiber manufacturing process includes a series of pairs of opposed air knives which provide alternating gaseous flows to a series of veils. All the air knives on one side of the machine are supplied by a common air piping system and the opposed air knives are supplied by a separate common air piping system, with a controller and valves operating to alternate the supply of air to first one side of the machine and then to the other. The control signal for one side of the machine is typically a square wave signal, such as shown as Graph A in FIG. 8. However, because of the accumulator effect inherent in the air piping system, the actual air flow is generally sinusoidal, as shown in Graph B of FIG. 8. It can be seen that the effect of the square wave is that the air velocity emitted from the prior art air knives increases sinusoidally. This produces a glass fiber blanket 38 having a nonuniform density. The nonuniformity of the sinusoidal wave is somewhat self-correcting when short fibers are being distributed, but can result in significant product nonuniformities when longer fibers (i.e., greater than about 3 cm) are being distributed. This is especially true where the fibrous flow being distributed is a thin, flat veil of fibers having an inherent structure or integrity of its own. Also, the accumulator effect dampens or muffles the signal to such an extent that attempts to provide air lapping of glass fiber veils using prior art apparatus at cycle times faster than about 2 hz. result in a generally steady flow of gases from the air knives rather than an intermittently on and off flow.

Figure 8:
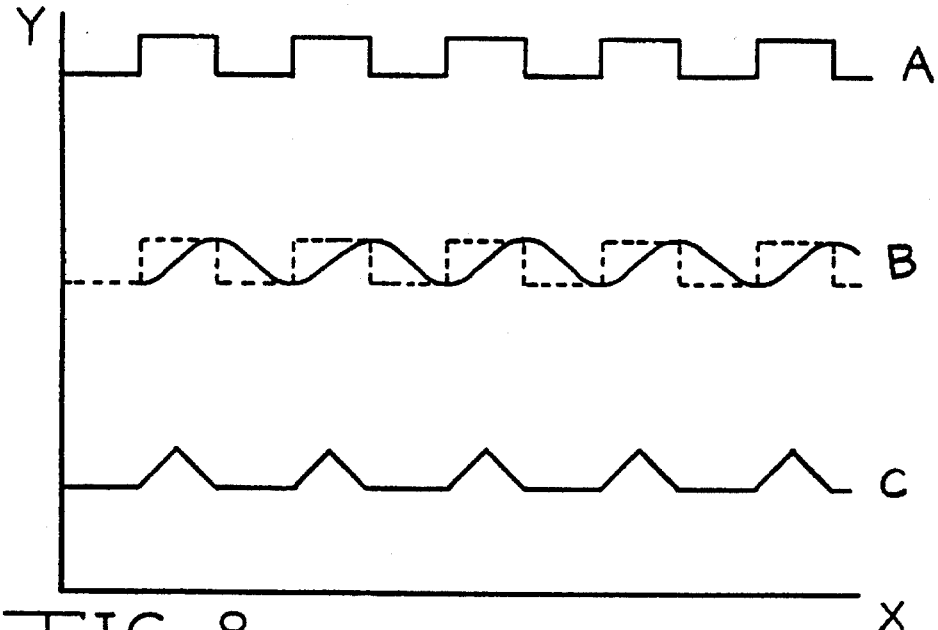
FIG. 8 is a graph illustrating the mass flow of the gases exiting the flow distributor as a function of time for various flow distribution patterns.

It has been found that the best way to ramp the mass flow from the flow distributor is to ramp the speed linearly up and down, as shown in Graph C in FIG. 8. The flat portions of Graph C in FIG. 8 are where the flow distributor is not emitting a gaseous flow during the time the opposed flow distributor is operating. By ramping the air velocity exiting the flow distributor up and down in a linear manner, the distribution of the glass fiber material will be more uniform. The thin web, which is traveling at a high speed, can be lapped from side to side many times a second, laying down folds or layers of the glass fiber web in an even fashion, substantially without wrinkling or stretching.

Several ways can be used with the method of the invention to linearly ramp the speed of the air velocity exiting the flow distributors. One method is to provide first surface openings and second surface orifices which are rectangular, as shown in FIG. 4. As the inner surface orifices 70 pass the outer distributor openings 66, the overlapping area will increase linearly in size up to a maximum size, and then will decrease linearly in size to a final state of no overlapping area. When the pressure in the air chamber 50 is higher than about 80 kPa (about 12 psi), the air exiting the flow distributor will be sonic. Therefore, the velocity of the air leaving the flow distributor will be generally constant. However, the linear increase in the overlapping or open area will result in a linear increase in mass flow rate exiting the flow distributor, as shown in Graph C of FIG. 8. Accordingly, the measure of the flow of gas from the distributors is the measure of the mass flow rate of the gas emitted from the distributors. It should be understood that downstream from the flow distributor variations in the mass flow rate may translate into variations in the velocity of the flow of gases. What is significant, however is the effect of the momentum or total pressure on the flattened veil of fibers.

Figure 5:
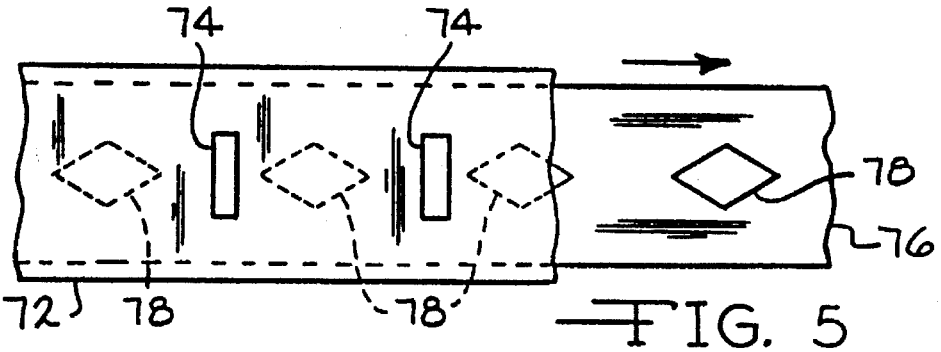
FIG. 5 is a view in elevation illustrating an alternate embodiment of the inner and outer distributor surface of the invention.

As shown in FIG. 5, the velocity of the gas flows from the flow distributor can be linearly ramped by providing an outer distributor surface 72 having rectangularly shaped outer distributor openings 74, where the inner distributor surface 76 has diamond shaped inner surface orifices 78.

Figure 6:
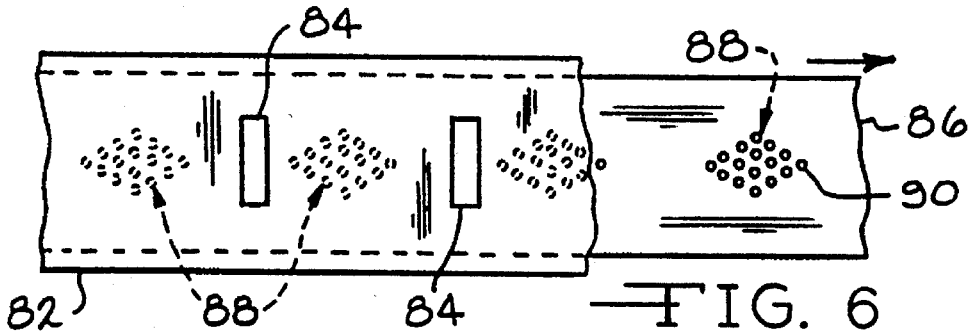
FIG. 6 is a view in elevation illustrating yet another embodiment of the inner and outer distributor surface of the invention.

In a similar manner to that shown in FIG. 5, as shown in FIG. 6, the velocity of the gas flows from the flow distributor can be linearly ramped by providing an outer distributor surface 82 having rectangularly shaped outer distributor openings 84, where the inner distributor surface 86 has generally diamond-shaped orifice clusters 88 comprised of a plurality of apertures 90 arranged in a diamond-shaped pattern.

Figure 7:
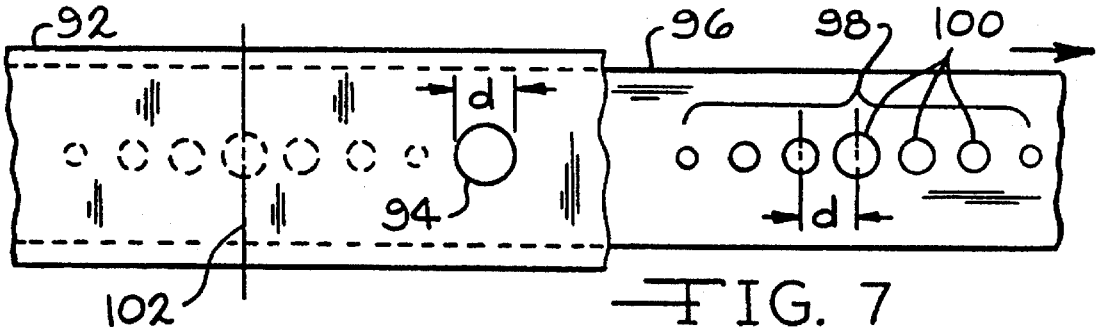
FIG. 7 is a view in elevation showing a different embodiment of the inner and outer distributor surface of the invention.

The embodiment shown in FIG. 7 illustrates the use of the invention where the outer distributor surface 92 has a plurality of outer distributor openings 94 which are circles, and the inner distributor surface 96 has orifices which comprise a plurality of orifice clusters 98, the orifice clusters comprising an array of apertures 100. The array of apertures in the clusters are generally symmetrical with respect to a center line, such as center line 102. The size of the apertures 100 in the clusters increases as the centerline 102 of the cluster moves toward the outer distribution opening 94, and decreases as the centerline moves away from the outer distribution opening. The apertures increase in size toward the center of the cluster, and decrease in size away from the center. When an orifice cluster such as shown in FIG. 7 is used, it is preferred to use a spacing d between centers of individual apertures which approximates the diameter d of the outer distributor openings 94.

The invention has been described with reference to the manufacture and distribution of fiberglass insulation. It is to be understood, however, that the invention can apply equally to fiber flows of other mineral fibers, as well as to fibers of organic material.

It will be evident from the foregoing that various modifications can be made to this invention. Such, however, are considered as being within the scope of the invention.

INDUSTRIAL APPLICABILITY

The invention can be useful in the manufacture of insulation materials used for thermal and acoustical insulation.

We claim:

1. A method for distributing fibrous material comprising: establishing a flow of fibrous material; positioning a pair of flow distributors on opposite sides of the flow of fibrous material to direct gaseous flows into contact with the flow of fibrous material, each flow distributor comprising a first surface having a set of one or more openings for the emission of gas, a second surface having a set of one or more orifices for the emission of gas, and a pressurized source of gas in contact with the second surface, one of the first and second surfaces being moveable with respect to the other of the first and second surfaces to intermittently align some of the openings with some of the orifices, thereby enabling gas from the pressurized source of gas to be emitted through the first and second surfaces and into contact with the flow of fibrous material to distribute the fibrous material; and moving one of the first and second surfaces relative to the other of the first and second surfaces to control the emission of gas from the flow distributor.

2. The method of claim 1 in which the intermittent flow of gas has a cycle time within the range of from about 1 to about 100 hz.

3. The method of claim 2 in which the cycle time is within the range of from about 2 to about 50 hz.

4. The method of claim 3 in which the cycle time is within the range of from about 5 to about 40 hz.

5. The method of claim 1 comprising alternating the emission of gas from the two flow distributors.

6. The method of claim 1 in which the one of the first and second surfaces oscillates relative to the other of the first and second surfaces.

7. The method of claim 1 in which the one of the first and second surfaces is mounted for movement as a flexible belt relative to the other of the first and second surfaces.

8. The method of claim 1 in which the first surface is a first cylinder having an opening directed toward the flow of fibrous material, and the second surface is a second cylinder mounted for rotation within the first cylinder, where the second cylinder contains orifices, and where the rotation of the second cylinder intermittently aligns the orifices with the opening.

9. A method for distributing fibrous material comprising: establishing a flow of fibrous material by centrifuging fibers from a rotary fiberizer and turning the fibers into a downwardly moving, generally cylindrical veil; intercepting the veil with a pair of rotating foraminous drums to change the veil; into a generally flat flow of fibrous material; positioning at least two flow distributors on opposite sides of the flow of fibrous material to direct a gaseous flow into contact with the generally flat flow of fibrous material, each flow distributor comprising a first surface having a set of one or more openings for the emission of gas, a second surface having a set of one or more orifices for the emission of gas, and a pressurized source of gas in contact with the second surface; and moving the second surface with respect to the first surface to intermittently align some of the openings with some of the orifices, thereby enabling gas from the pressurized source of gas to be emitted through the first and second surfaces and into contact with the generally flat flow of fibrous material to distribute the fibrous material, where the gas is emitted from the flow distributors with a cycle time within the range of from about 2 to about 50 Hz.

10. Apparatus for distributing a flow of fibrous material comprising: a pair of flow distributors on opposite sides of the flow of fibrous material positioned to direct gaseous flows into contact with the flow of fibrous material, each flow distributor comprising a first surface having a set of one or more openings for the emission of gas, a second surface having a set of one or more orifices for the emission of gas, and a pressurized source of gas in contact with the second surface, the first surface being moveable with respect to the second surface to intermittently align some of the openings with some of the orifices, thereby enabling gas from the pressurized source of gas to be emitted through the first and second surfaces and into contact with the flow of fibrous material to distribute the fibrous material, the first surface being moveable relative to the second surface to control the emission of gas from the flow distributor.

11. The apparatus of claim 10 in which the set of openings in the first surface comprises a continuous slot.

12. The apparatus of claim 10 in which the first surface comprises a flexible belt mounted for movement relative to the second surface.

13. The apparatus of claim 10 in which the first and second surfaces are concentric cylinders.

14. The apparatus of claim 10 comprising a rotary fiberizer adapted to fiberize molten material and form the flow of fibrous material as a downwardly moving veil of fibrous material, and a pair of rotating foraminous drums adapted to change the downwardly moving veil of fibrous material into a generally flat flow of fibrous material, where the flow distributors impinge their gaseous flows on the generally flat flow of fibrous material.

15. Apparatus for distributing a flow of fibrous material comprising: a collection surface; two or more flow distributors positioned to direct a gaseous flow into contact with the flow of fibrous material and distribute the fibrous material onto the collection surface, the flow distributors comprising a first surface having a set of one or more openings for the emission of gas, a second surface having a set of one or more orifices for the emission of gas, and a pressurized source of gas in contact with the second surface, the second surface being moveable with respect to the first surface to intermittently align some of the openings with some of the orifices, thereby enabling gas from the pressurized source of gas to be emitted through the first and second surfaces and into contact with the flow of fibrous material to distribute the fibrous material, the second surface being moveable relative to the first surface to control the emission of gas from the flow distributor.

16. The apparatus of claim 15 in which the second surface comprises a flexible belt mounted for movement relative to the first surface.

17. The apparatus of claim 15 comprising a rotary fiberizer adapted to fiberize molten material and form the flow of fibrous material as a downwardly moving veil of fibrous material, and a pair of rotating foraminous drums adapted to change the downwardly moving veil of fibrous material into a generally flat flow of fibrous material, where the flow distributors impinge their gaseous flows on the generally flat flow of fibrous material to distribute the fibrous material onto the collection surface.

* * * * *